US007752791B2

(12) United States Patent
Misawa et al.

(10) Patent No.: US 7,752,791 B2
(45) Date of Patent: Jul. 13, 2010

(54) DISPLAY DEVICE

(75) Inventors: Akihiro Misawa, Aichi-ken (JP); Kazuo Takeda, Aichi-ken (JP); Tatsuya Oba, Aichi-ken (JP)

(73) Assignee: Toyoda Gosei Co., Ltd., Nishikasugai-gun, Aichi-ken (JP)

( * ) Notice: Subject to any disclaimer, the term of this patent is extended or adjusted under 35 U.S.C. 154(b) by 0 days.

(21) Appl. No.: 11/898,579

(22) Filed: Sep. 13, 2007

(65) Prior Publication Data

US 2008/0066355 A1 Mar. 20, 2008

(30) Foreign Application Priority Data

Sep. 15, 2006 (JP) ..... P. 2006-250434

(51) Int. Cl.
*G09F 13/18* (2006.01)

(52) U.S. Cl. ..... 40/546; 40/219

(58) Field of Classification Search ..... 40/546, 40/219, 582, 900, 443; 472/63
See application file for complete search history.

(56) References Cited

U.S. PATENT DOCUMENTS 4,965,950 A * 10/1990 Yamada ..... 40/546
4,974,354 A * 12/1990 Hembrook, Jr. ..... 40/546
5,027,258 A * 6/1991 Schoniger et al. ..... 362/629
5,787,618 A * 8/1998 Mullis ..... 40/219
6,889,456 B2 * 5/2005 Shibata et al. ..... 40/546
6,971,758 B2 12/2005 Inui et al.
7,107,712 B2 * 9/2006 Mueller ..... 40/546
7,182,492 B1 * 2/2007 Walter ..... 362/497
7,192,148 B2 * 3/2007 Tsai et al. ..... 362/29

FOREIGN PATENT DOCUMENTS

JP 2002-279817 9/2002
JP 2005-221661 8/2005
JP 2006-062431 3/2006

* cited by examiner

*Primary Examiner*—Joanne Silbermann
(74) *Attorney, Agent, or Firm*—McGinn IP Law Group PLLC

(57) ABSTRACT

The objective of the present invention is to provide a display device that presents great decorative effects.

For a display device that provides a luminous display consisting of characters, numbers, symbols or figures, or arbitrary combinations of them, having a desired form, a half mirror layer is formed above a mirror surface, through a translucent layer, and a desired form is luminously displayed at a location between the mirror surface and the half mirror layer and at a distance from the mirror surface.

20 Claims, 7 Drawing Sheets

DISPLAY DEVICE

BACKGROUND OF THE INVENTION

1. Field of the Invention

The present invention relates to a display device for luminously displaying a desired form, such as a character or a number. The display device of the present invention is used as a decorative item for a vehicle, such as a scuff plate for an automobile or a vehicle interior ceiling ornament, and as a decorative mount for a name plate on a house exterior or as a ceiling ornament inside a house or a building.

2. Description of the Related Art

An automobile scuff plate device that luminously displays characters and provides a decorative effect has been put to practical use. An example of a scuff plate device 100, of a conventional light transmission type, is shown in FIG. 7. For the scuff plate device 100, a character plate 101 (e.g., an aluminum plate), in which characters having a desired form have been stamped out, is laminated on a rectangular light guidance plate 102, to which a white backing material has been applied. At one longitudinal end of the light guidance plate 102 a light source 103 is mounted. Then, when the light source 103 for the scuff plate device 100 is turned on, light is guided into the light guidance plate 102, via the end of the light guidance plate 102, and is reflected from the reverse face of the light guidance plate 102 and directed towards the upper face of the light guidance plate 102. As a result, light is output from the upper face of the light guidance plate 102, and reaches the character plate 101. Then, part of the light is emitted, through the stamped out portions in the character plate 101, luminously displaying the desired characters. In addition to this arrangement, various display devices having other arrangements have been proposed (see, for example, patent documents 1 to 3).

Patent Document 1: JP-A-2002-279817

Patent Document 2: JP-A-2005-221661

Patent Document 3: JP-A-2006-062431

According to a conventional scuff plate device, specific decorative effects are obtained by luminously displaying characters. However, since the characters are bright only in the plane, the decorative effect obtained is not fully satisfactory, and an increased sense of luxury is desirable. To this end, however, even though the stereoscopic effect is enhanced, to a degree, when the thickness of the character plate is increased, the maximum, effectively acquired stereoscopic depth effect is equivalent only to the thickness of the character plate. Furthermore, an attempt to provide a more luxurious luminous image by increasing the thickness of the character plate serves only to improve the stereoscopic effect; no marked improvement in the decorative effect is acquired when the means used to achieve this objective is a mere increase in the thickness of the character plate. In addition, since the thickness of the character plate directly affects the thickness of the entire device, and because design requirements impose limits on the thickness of the device, thickening the character plate is not a viable solution.

SUMMARY OF THE INVENTION

While taking these problems into account, one objective of the present invention is to provide a display device having the following configuration. According to the present invention, a display device that provides a luminous display consisting of characters, numbers, symbols or figures, or arbitrary combinations of them, having a desired form, comprises:

a mirror surface;

a half mirror layer, formed above the mirror surface, through a translucent layer; and a light emitting unit, located between the mirror surface and the half mirror layer and positioned at a distance from the mirror surface, so as to provide a desired, luminous form.

According to the display device of this arrangement, luminous characters are projected directly or are reflected onto the half mirror layer, and a mirror image is generated on the mirror surface. This mirror image is reflected by the half mirror layer, and a new mirror image is generated. Since the generation and reflection of the mirror image is repeated, from the front to the rear, multiple contiguous luminous images are observed via the half mirror layer. As a result, a display form can be obtained that provides a stereoscopic or depth impression and a satisfactory decorative effect. Therefore, spatial effects can also be produced. Thus, when this display is decoratively employed on the ceiling, for example, inside a vehicle or a building, and spatial depth effect can be provided, or a sense of spaciousness can be produced. Furthermore, with this arrangement, not only can satisfactory decorative effects can be provided, but also the thickness of a display device can be reduced, so that the design of the device can also be improved.

Figure 1:
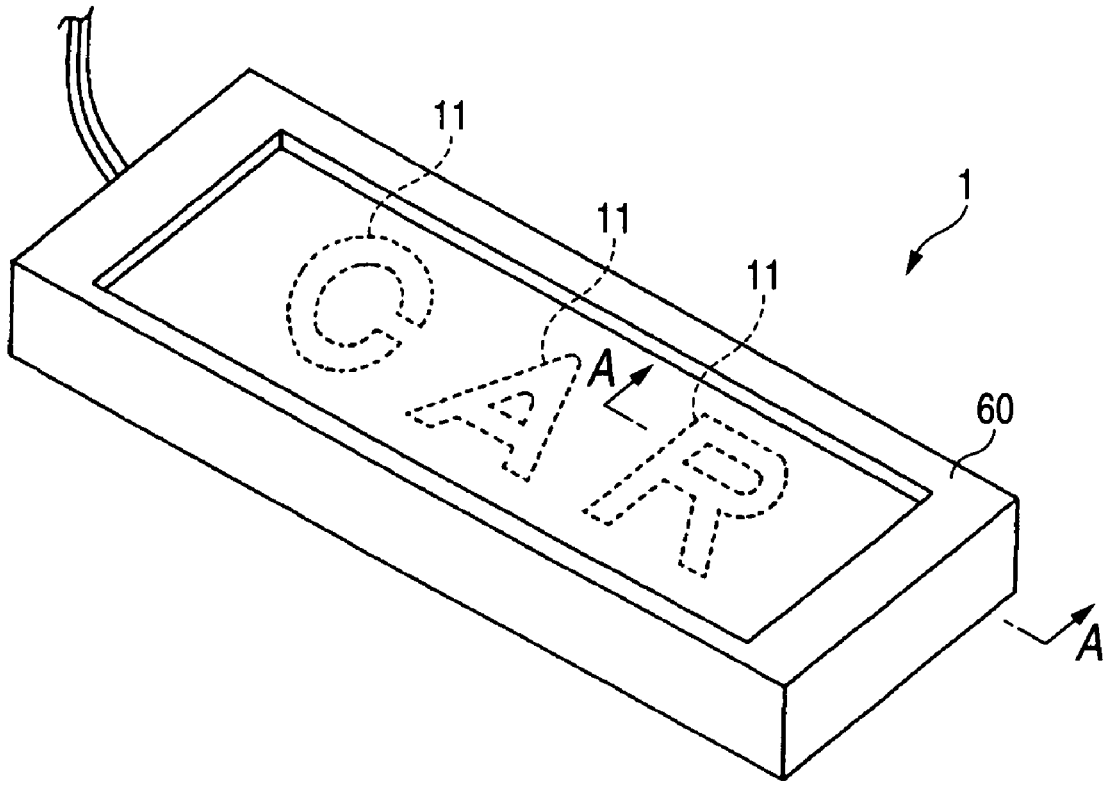
FIG. 1 is a perspective view of a display device according to a first embodiment of the present invention.

DESCRIPTION OF THE PREFERRED EMBODIMENTS (Mirror Surface)

A mirror surface, together with a half mirror layer that will be described later, acts to generate a luminous image that provides a stereoscopic effect or a sense of depth. So long as a mirror image can be generated by projecting a luminous image of characters by employing a light emitting unit, which will be described later, the material and the reflectivity of the mirror surface are not particularly limited. It should be noted, however, that a high reflectivity for the mirror surface is preferable, so that a clear mirror image can be generated. For this purpose, a material, such as Al (aluminum), or Ag (silver), or an alloy of them, can be employed for forming the secular face.

When a translucent layer is formed as a light guidance member, as will be described later, specular processing is performed for the lower face of the translucent layer, so as to obtain the mirror surface of the present invention. Specifically, to prepare the mirror surface, vapor deposition is used to form a material, such as Al, on the lower face of the translucent layer.

An Al plate on which the specular processing has been performed, or a resin plate on which a specular material has been deposited or coated, may also be prepared, and the surface of this plate may be employed as a mirror surface.

Generally, a flat, mirror surface is employed; however, the mirror surface is not limited to a flat face. Part of a mirror surface, for example, or an entire mirror surface may be curved in order to provide a variety of luminous displays.

(Half Mirror Layer)

The half mirror layer is located above the mirror surface. According to the display device of this invention, the side where the half mirror layer is formed is used as the observation face side (the design face side). And located between the mirror surface and the half mirror layer is a translucent layer. Therefore, the mirror surface, the translucent layer and the half mirror layer are arranged in this order toward the observation face.

When the display device of this invention is not in the display state, or when the external illuminance is high, as in the daytime, the observation face of the display device assumes a metallic appearance. Therefore, since when not in the display state the inside of the display device can not be seen, the unsightly appearance of a design that may appear when the display device is not in the display state can be eliminated, and a unique design employing a metallic color can be provided. On the other hand, when the display device is in the display state, a luminous image of characters, for example, can be seen through the half mirror layer. As described above, when not in the display state is shifted to in the display state, the tone and the texture on the observation face side are greatly changed, and at the same time, characters, for example, appear. As a result, surprising effects can be produced.

A metal layer (e.g., Al, Ag or Au) having a predetermined film thickness can be employed as the half mirror layer. Or, a metal layer and a protective layer made of a light transmitting resin may also be laminated to form the half mirror layer. An example method for forming this half mirror layer will be described. First, a metal layer composed of an Al thin film is deposited. This metal layer should have sufficient thickness to provide half mirror effects, i.e., a thickness such that the transmittance of light is from about 15 to 20%. Sequentially, printing or coating deposition is employed to apply to and overlay the metal layer with a protective layer of a transparent resin, such as an epoxy resin. The structure of the half mirror layer and its formation method are not limited to these, and another well known structure and method can also be employed. Further, an ink layer may also be formed either on the surface of the protective layer or between the metal layer and the protective layer. Printing or the deposition of a coating can be employed to apply an ink layer of yellow ink, for example.

(Translucent Layer)

The translucent layer is formed of a light guidance layer or by using air. In this invention, the translucent layer may be formed using air, as mentioned above, or two or more translucent layers may be prepared. In the second case, a translucent layer made of a light guidance member and a translucent layer prepared using air may coexist.

The material of the light guidance member is not especially limited, so long as a light transmitting material, and preferably, a transparent material is employed to form the light guidance member. Further, it is preferable that the light guidance member be made of a material that can easily be processed and that is superior in durability. An example material for the light guidance member can be a polycarbonate resin, an acrylic resin, such as a methacrylic resin (PMMA), an epoxy resin or glass. Further, a well known injection molding method can be employed for processing the light guidance member.

(Light Emitting Unit)

The light emitting unit is arranged, between the mirror surface and the half mirror layer, at a position at a distance from the mirror surface, and makes a luminous form consisting of: desired characters, such as arbitrary hiragana, katakana or Chinese characters or alphabetical letters; numbers, such as Arabic or Chinese numbers; symbols, such as mathematical or map symbols; figures, such as circles, triangles or quadrilaterals; or an arbitrary combination of the foregoing forms (hereinafter collectively referred to as a character set). Preferably, surface emission is performed for a specific character set in order to obtain great decorative effects and high visibility. In this invention, a predetermined distance is maintained between the luminous area and the specular area. Therefore, the luminous image of the character set is projected onto the mirror surface, and a mirror image is generated. The predetermined distance is, for example, 2 mm to 10 cm, although in this case it is not especially limited. When too short a distance is used, the effects of the invention, i.e., presentation of a display form with stereoscopic effects and a sense of depth, are not satisfactorily produced. On the other hand, since this distance is affected by the thickness of the display device, too long a distance is also not preferable. The distance set should be within a range of 3 mm to 5 mm.

According to one aspect of this invention, an area for forming a character set, i.e., a luminous area, is located at a distance from both the mirror surface and the half mirror layer. That is, a predetermined distance is also ensured between the luminous area and the half mirror layer. Therefore, a luminous image can be generated with stereoscopic effects and a sense of depth can be better presented. To set the distance in this case, as well as the distance between the luminous area and the mirror surface, both the effects provided by the invention and the thickness of the display device should be taken into account. The distance should be, for example, 2 mm to 5 mm, and preferably 2 mm to 3 mm.

According to an aspect of this invention, a reflection and diffusion area, having the form of a character set, and a light source that projects light onto the reflection and diffusion area are prepared as a light emission unit. In this embodiment, a character set is rendered luminous by light received from the light source. The reflection and diffusion area is formed on the surface or in the inside of the light guidance member, and with this arrangement, light emitted by the light source is transmitted, via the light guidance member, to the reflection and diffusion area. The positional relationship of the light source and the light guidance member is not especially limited, and the light source, for example, can be located opposite the end face of the light guidance member. According to this arrangement, light that has entered at the end face of the light guiding face is guided to project the reflection and diffusion area. The light source may be embedded (in-molding) in the light guidance member. According to this arrangement, the light guidance member can also serve as a waterproof member for the light source. This arrangement is also an effective one for downsizing.

An example method for forming the reflection and diffusion area on the surface of the light guidance member can be surface roughing that uses, for example, sand blasting, etching or electric discharge machining, vapor deposition, coating or printing performed with a light reflecting/diffusing material, or the adhesion of a light diffusion film or tape. Further, an example method used to form a reflection and diffusion area inside the light guidance member can be laser processing or film in-molding. When the above described translucent layer is formed of a light guidance member, the translucent layer (or a part of it) can be employed as the light guidance member described here. It should be noted that, regardless of the structure of the translucent layer, the light guidance member here may also be prepared separately from the translucent layer.

The light source type is not especially limited; however, an LED lamp is preferable because small size, low power consumption and long service life are desirable objectives. An arbitrary type of LED lamp, such as a cannonball type or a chip type, can be employed. As an additional merit for the employment of an LED lamp as a light source, little heat will be generated by the light source, and the thermal affect on peripheral members can be reduced.

The color of the light emitted by the light source is also not especially limited. A plurality of light sources that emit different colors of light can also be employed. When multiple light sources are employed, in various modes, light can be projected by controlling the light emitting state of the light sources. For example, when red, green and blue LEDs are employed as light sources, and the light emitting states and the emitted light quantities of these LED lamps are controlled, a light having a desired color can be emitted. The number of LED lamps to be employed can be determined by considering, for example, the size of a light guidance member and the required luminance level.

According to this aspect of the invention, a set of characters are luminously displayed by using light emitted by the light source. According to another aspect of the invention, a character set rendered that is voluntarily luminescent. For example, an organic EL (electronic luminescence) surface emission element can be employed for a character set. By using the organic EL element, the thickness of a display device and the consumption of power can be reduced. The basic structure of an organic EL element is such that a Hall transport layer, a light emitting layer and an electron transport layer can be formed between a transparent electrode (anode) and a rear electrode (cathode) (see, for example, JP-A-2002-124391). An organic EL element having a structure other than this can also be employed for this invention (see, for example, JP-A-11-102166, JP-A-2001-332389, JP-A-2004-111158 or JP-A-2005-353504).

First Embodiment

Figure 2:
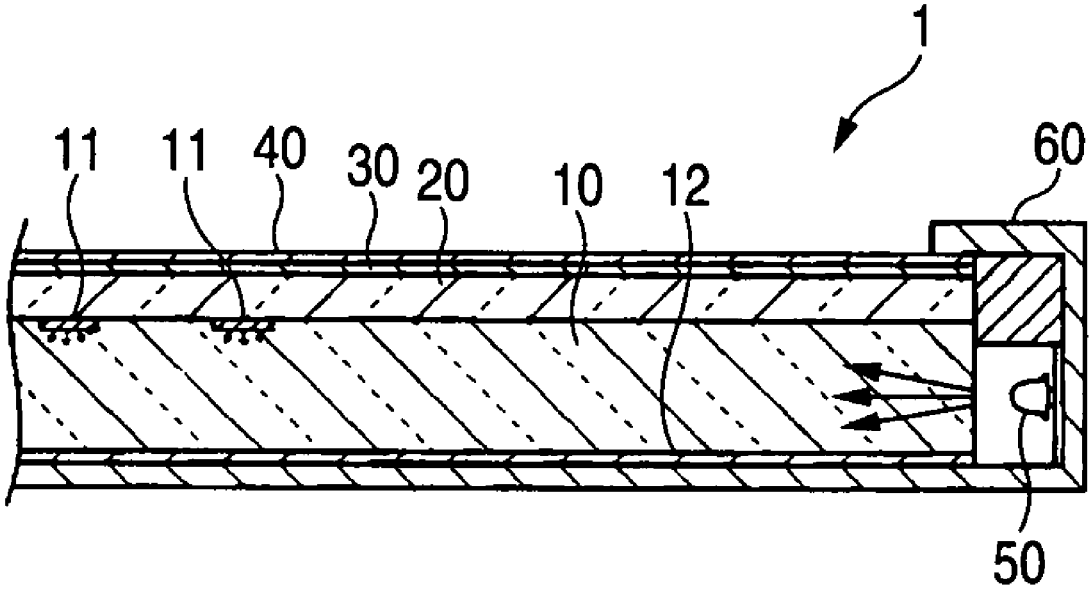
FIG. 2 is a cross sectional view of the display device according to the first embodiment.

A display device 1 according to the embodiment of the present invention is shown in FIGS. 1 and 2. FIG. 1 is a perspective view of the display device 1, and FIG. 2 is a cross sectional view of this device taken along a line A-A in FIG. 1. The structure of the display device 1 and a display style provided by the display device 1 will now be described while referring to FIGS. 1 and 2. It should be noted that the display device 1 is employed for the decoration of a scuff plate for an automobile.

In the display device 1, a first light guidance member 10, a second light guidance member 20, a half mirror film 30 and a protective plate 40 are laminated, in this order, toward the observation face side (above in the figure), and this laminated structure is stored in a cover 60. The individual members, such as the first light guidance member 10, of the structure are rectangular members having substantially the same shape in plan view. The first light guidance member 10 is made of an acrylic resin and has a thickness of a bout 3 mm. A character area 11 having a desired form (characters CAR in this embodiment) is formed in a part of the upper face of the first light guidance member 10. By employing a blasting process, a reflection and diffusion property can be provided for the character area 11. On the other hand, since Al is uniformly deposited on the reverse face of the first light guidance member 10, a mirror surface 12 can be prepared that contacts the reverse face of the first light guidance member 10.

As well as the first light guidance member 10, the second light guidance member 20 is made of an acrylic resin and has a thickness of about 3 mm. The half mirror film 30 is adhered to the upper face of the second light guidance member 20.

A light source 50 is located at a position opposite the end face of the first light guidance member 10. The light source 50 is an LED lamp of a cannonball type (a lens type that emits an umber colored light. When the display device 1 is mounted in a vehicle, power is supplied via a harness to the LED lamp 50. Further, a power control circuit (not shown) is also connected to the LED lamp 50, so that the LED lamp 50 can be turned on or off, interacting, for example, with the ON/OFF state of a side-marker light. In this embodiment, light enters at the right and left end faces of the first light guidance member 10, and two LED lamps are employed. However, the number of LED lamps can be changed as needed. Further, instead of light entering at the two end faces of the first light guidance member 10, as in this embodiment, various entry methods can be employed, e.g., light may enter only at either the right or the left end face, or light may enter at the top and the bottom end faces, as well as at the right and left end faces.

The protective plate 40, which is overlaid on the half mirror film 30, is made of a polycarbonate resin and is prepared so as to protect the half mirror film 30 and to prevent the entry of dust and water. In order to obtain satisfactory dust exclusion and waterproofing effects, the upper edges of the protective plate 40 are connected to the cover 60 using a sealing member, without any gap.

The cover 60 is made of a stainless steel (SUS), and has a thickness of about 0.5 mm. In one face of the cover 60, except near one of the edges, a rectangular opening is formed, and in the display device 1, a luminous character display is presented through this opening. The cover 60 serves as a protective member, and is also an important element in the design of the display device 1. In this embodiment, as described above, stainless steel is employed for the cover 60, so that the cover 60 matches the metallic tone and texture of the half mirror film 30.

Figure 3:
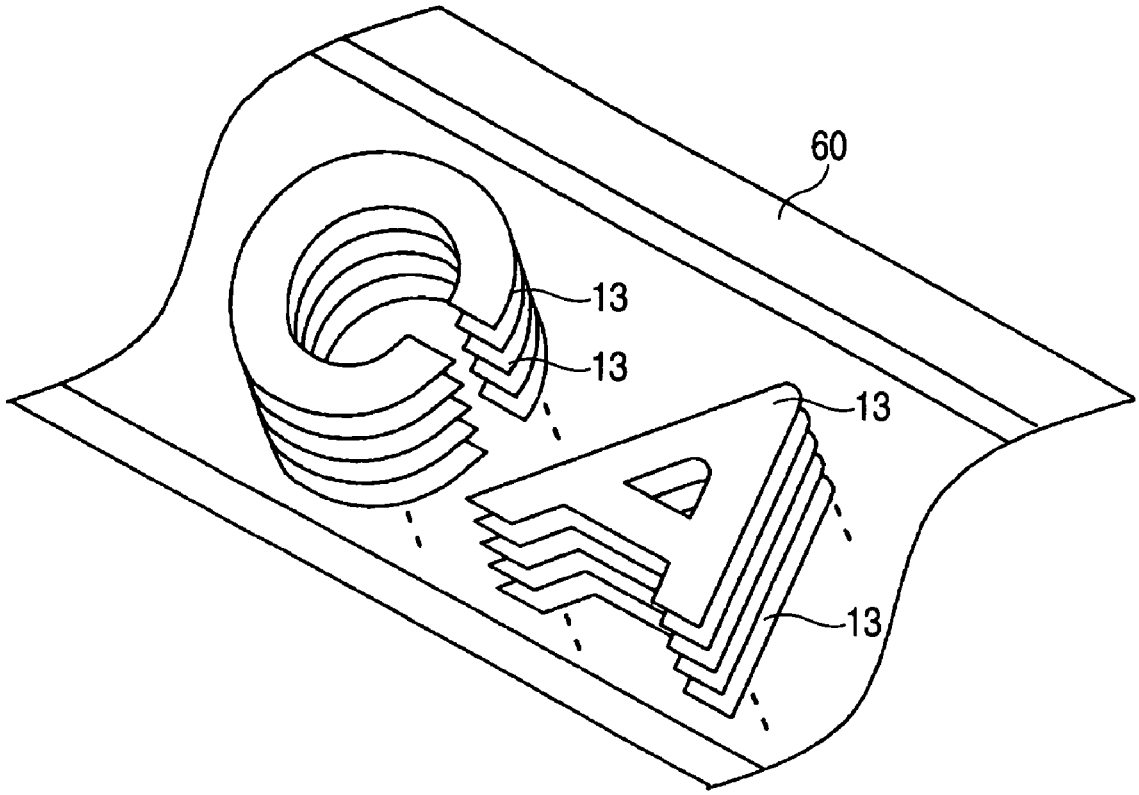
FIG. 3 is a schematic perspective view of a display style provided by the display device of the first embodiment.

The display style of the display device 1 having the above arrangement will now be described. During a period, such as the daytime, wherein the external illuminance is high, the display device 1 enters a no display state (the light source 50 is in the OFF state). At this time, on the observation face of the display device 1 (excludes the cover 60), a metallic tone and texture display appears as a result of the performance of the half mirror film 30. During a period of low external illuminance, such as at night, when the light source 50 is turned on, light emitted by the light source 50 enters the first light guidance member 10, interacting with light emitted as a result of the ON state of the side-marker light (the display state of the display device 1). Then, the light is guided along the inside the first light guidance member 10, and projects the character area 11 that is formed on the upper face of the first light guidance member 10. As a result, the character area 11 becomes luminous, and the surface emission image of the characters (CAR) is directly projected, or is projected by being reflected in the half mirror film 30, and a mirror image is generated on the mirror surface 12. This mirror image is thereafter reflected by the half mirror film 30 and a new mirror image is produced. The generation and reflection of a mirror image using the mirror surface 12 and the half mirror film 30 is repeated, and as a result, a plurality of luminous images (luminous characters) 13, contiguous from the front to the rear, can be observed, as shown in FIG. 3. Although it is thin, the display device 1 can appropriately provide a character display that includes stereoscopic effects and the sensation of depth, and that can produce great decorative effects and impart a sense of high quality. Further, a sense of spaciousness can also be provided.

Furthermore, when the display device 1 is shifted from the no display state to the display state, characters suddenly appear because of the function of the half mirror film 30. Therefore, at the moment the shifting to the display state is effected, surprising effects can also be obtained.

Figure 4:
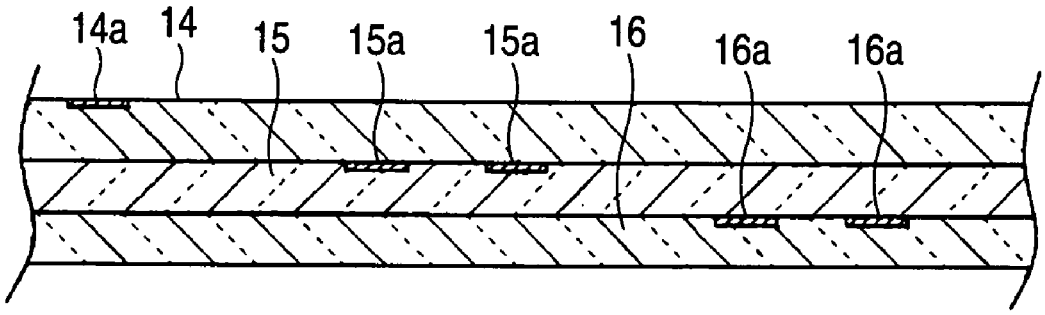
FIGS. 4A and 4B are cross sectional views of example structures for a character area.
Figure 4:
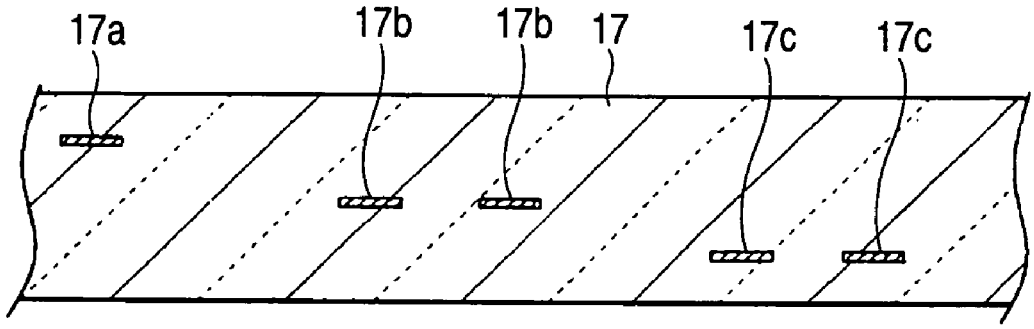

In this embodiment, all the characters (CAR) are displayed using the same style. However, more variety in the display form can be provided by revising the formation of the character area. For example, when a reflection and diffusion method is changed for each character, a different luminous style can be obtained between characters. In addition, as shown in FIG. 4A, a light guidance member may be prepared for each character, and the distance from the mirror surface may differ for each character. Then, the stereoscopic effect and the sense of depth obtained can be more greatly exaggerated, and a varied display style obtained. In the example shown in FIG. 4A, three light guidance members 14, 15 and 16 are prepared, and character areas (reflection and diffusion areas) 14*a*, 15*a* and 16*a* for one character are formed for the individual light guidance members. However, using laser processing, the same character areas can be provided for one light guidance member 17 (FIG. 4B). It should be noted that in FIGS. 4A and 4B character areas 14*a* and 17*a* are used for letter C, character areas 15*a* and 17*b* are used for letter A, and character areas 16*a* and 17*c* are letter R.

Second Embodiment

Figure 5:
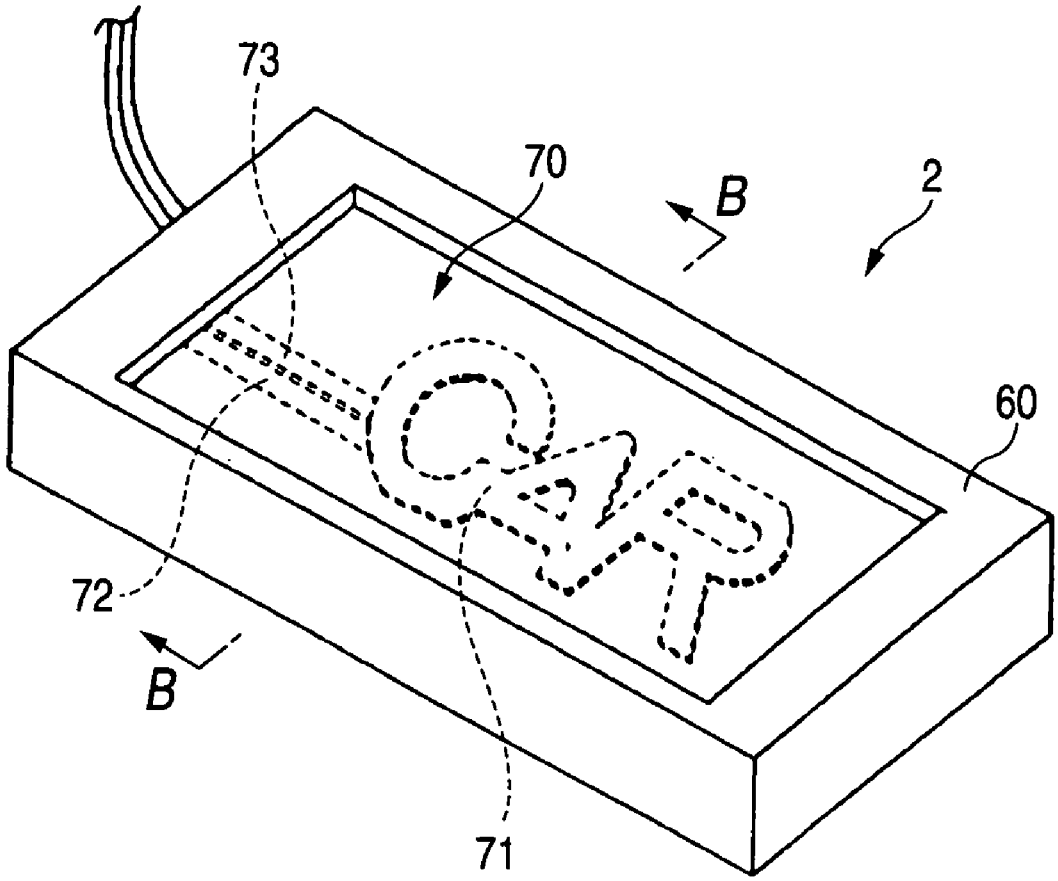
FIG. 5 is a perspective view of a display device according to a second embodiment of the present invention.
Figure 6:
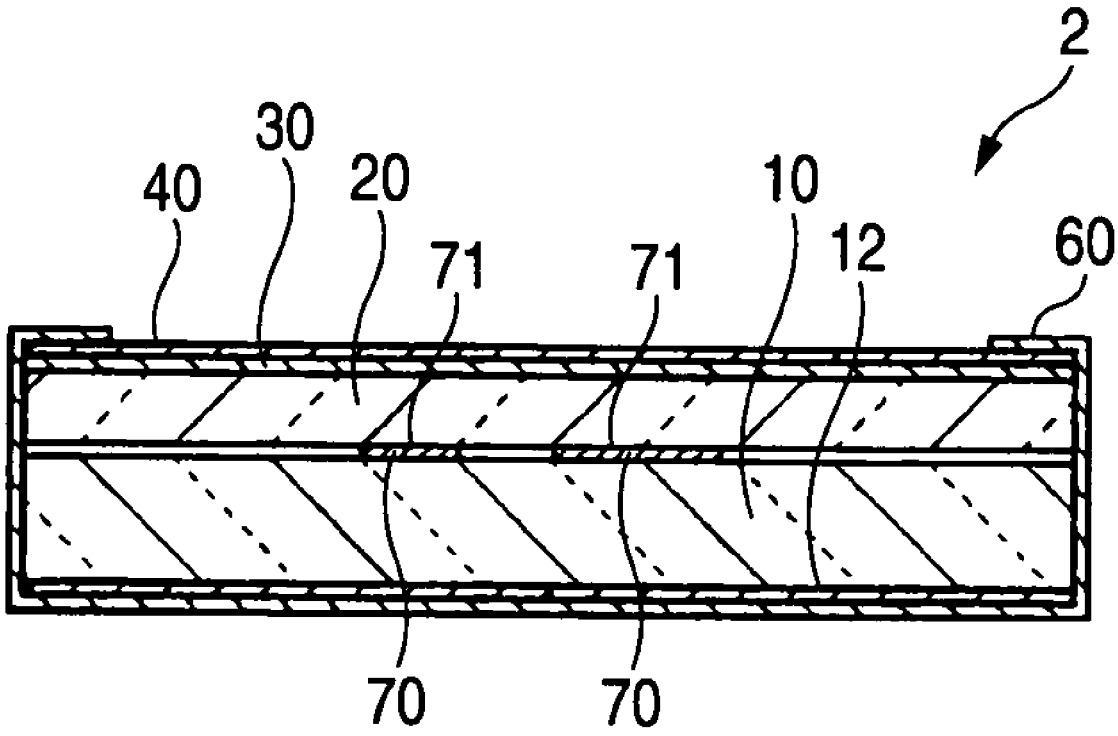
FIG. 6 is a cross sectional view of the display device according to the second embodiment.
Figure 7:
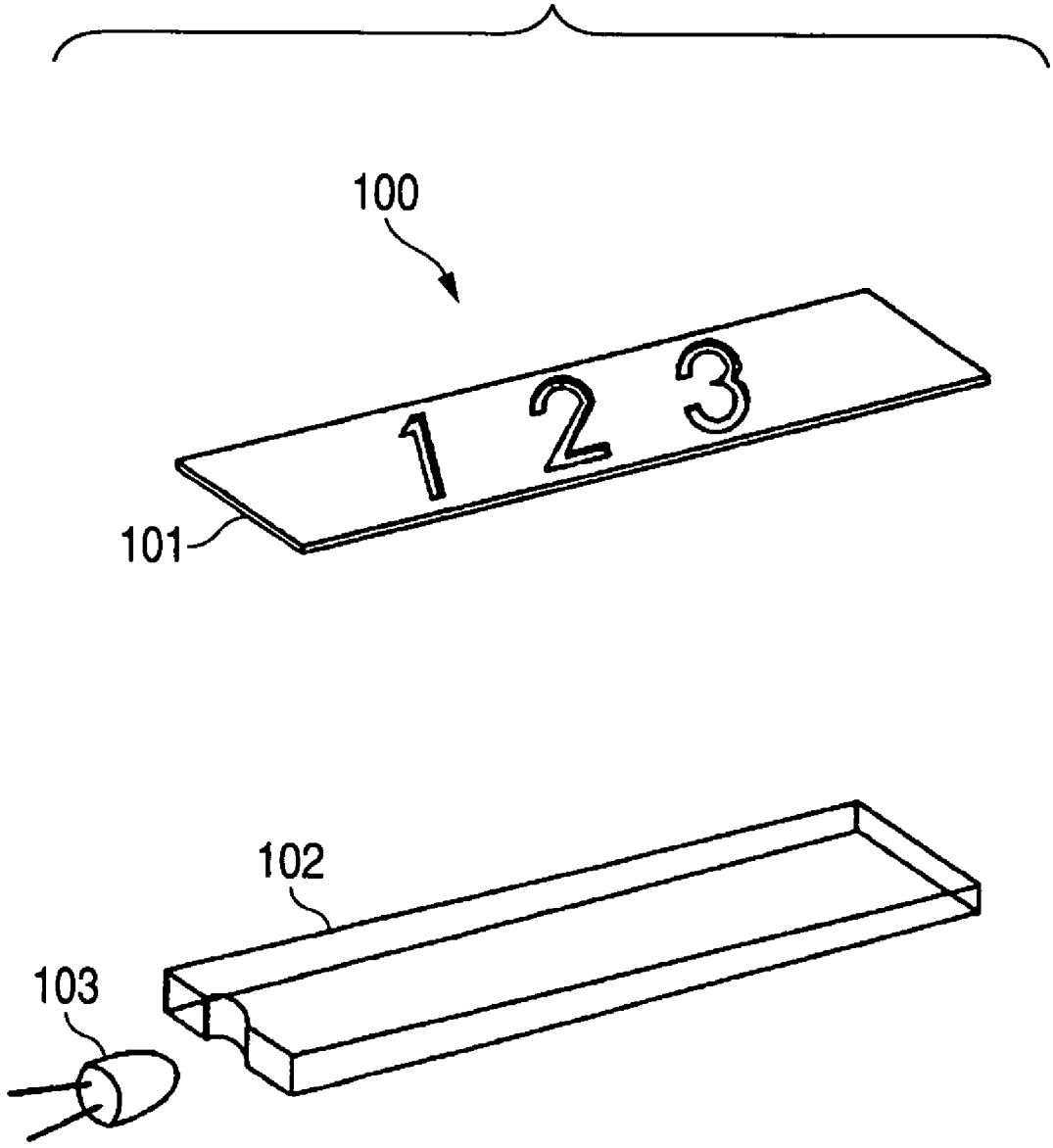
FIG. 7 is a perspective view of a conventional scuff plate device.

Another embodiment of the present invention is shown in FIGS. 5 and 6. FIG. 5 is a perspective view of a display device 2 according to the second embodiment, and FIG. 6 is a cross sectional view of the display device 2 taken along a line B-B in FIG. 5. The same reference numerals as used in the first embodiment are provided for identical or corresponding members, and for them, no further explanation will be given.

For the display device 2, an EL element 70 is employed for luminously displaying characters. The EL element 70 has a structure wherein a rear electrode layer, a dielectric layer, a light emitting layer and a transparent electrode layer (ITO) are laminated in order. Further, a protective layer made of a translucent film is deposited under the rear electrode layer and on the transparent electrode layer. As shown in FIG. 6, the EL element 70 has a shape, in plan view, that enables the surface emission of desired characters (CAR in this embodiment). The EL element 70 can be produced through laser processing performed by an EL element that has an appropriate shape (e.g., a rectangle) in plan view, or by adjusting the shapes of the individual layers during a process performed for forming an element structure. When power is supplied via transparent wiring cables 72 and 73, characters CAR become luminous, in blue, via an upper face 71 of the EL element 70.

In the display device 2, the EL element 70 is located between a first light guidance member 10 and a second light guidance member 20. On the whole, the display device 2 has a structure obtained by laminating a mirror surface 12, the first light guidance member 10, the EL element 70, the second light guidance member 20, a half mirror film 30 and a protective plate 40.

The design of the display device 2 in the no display state (during which the EL element 70 emits no light) is the same as that in the first embodiment, i.e., a metallic design is presented by the function provided by the half mirror film 30. On the other hand, in the display state, the EL element 70 emits light, and the following display style is presented. That is, the surface-emitting image of characters (CAR) is repetitively reflected by the half mirror film 30 and the mirror surface 12, and accordingly, a mirror image is generated. As a result, as well as in the first embodiment, multiple luminous images (luminous characters), contiguous from the front to the rear, are observed. As described above, the display device 2 also provides a display style having a great decorative effect and a high sense of quality. Furthermore, surprising effects can also be produced using the function of the half mirror film 30. It should be noted that the thickness of the display device 2 is reduced by using the EL element 70.

The preferred embodiments of the present invention have been described. However, employment of the display device of the invention is not limited to the scuff plate portion of an automobile, and can also be applied and used decoratively for various other portions, e.g., the display of a logo mark at a center cluster, steering wheels, a back garnish, doors and pillars. Further, the present invention can be applied not only for decorating automobiles, but also for display plates for various types of vehicles and display plates used for the interior and exterior of buildings such as houses and offices. Also, the present invention can be applied for decorations for the ceilings of vehicles or buildings. For this usage, in addition to the decorative effects, a sense of depth and space can be provided, or a sense of spaciousness can be produced. In this manner, the invention can also be employed as means for producing spatial effects.

The present invention is not limited to the aspects and the embodiments of the present invention. Furthermore, without departing from the subject described in the claims, this invention also includes various other modifications that one having ordinary skill in the art can easily determine are appropriate.

The contents of papers, Japanese patent applications laid open and granted patents enumerated in this specification should be employed by being cited.

What is claimed is:

1. A display device that provides a luminous display including a character, a number, a symbol or a figure, or an arbitrary combinations of them, having a desired form, said display device comprising:

a mirror surface;

a half mirror layer formed above the mirror surface through a translucent layer, said translucent layer filling up an entirety of a space between said half mirror layer and said mirror surface without an air gap therebetween; and at least one light reflection and diffusion unit located between the mirror surface and the half mirror layer and positioned at a distance from the mirror surface, so as to provide a desired luminous form, wherein the translucent layer includes at least one light guidance member, wherein the at least one light guidance member includes the at least one light reflection and diffusion unit, and wherein the light reflection and diffusion unit is formed on a surface of the at least one light guidance member.

2. The display device according to claim 1, wherein a formation area of the desired luminous form is located at a distance from both the mirror surface and the half mirror layer.

3. The display device according to claim 1, further comprising a light source for emitting light toward the light reflection and diffusion unit.

4. The display device according to claim 3, wherein the light emitted by the light source is projected, via the at least one light guidance member, onto the light reflection and diffusion unit.

5. The display device according to claim 3, wherein the light source comprises an LED lamp.

6. The display device according to claim 1, wherein the light emitting unit comprises an organic EL (electronic luminescence) element that performs surface emission to illuminate a desired form.

7. The display device according to claim 1, wherein the at least one light guidance member includes a first light guidance member and a second light guidance member.

8. The display device according to claim 7, wherein the at least one light reflection and diffusion unit is disposed between the first light guidance member and the second light guidance member.

9. The display device according to claim 8, wherein the at least one light reflection and diffusion unit includes a first light reflection and diffusion unit and a second light reflection and diffusion unit, and wherein the first light reflection and diffusion unit is disposed on a surface of the first light guidance member and the second light reflection and diffusion unit is disposed on a surface of the second light guidance member.

10. The display device according to claim 1, wherein the at least one light reflection and diffusion unit includes a first light reflection and diffusion unit and a second light reflection and diffusion unit, and wherein both the first light reflection and diffusion unit and the second light reflection and diffusion unit are disposed inside the at least one light guidance member.

11. The display device according to claim 1, wherein the at least one light guidance member comprises at least one of a polycarbonate resin, an acrylic resin, a methacrylic resin (PMMA), an epoxy resin, and glass.

12. The display device according to claim 1, wherein the at least one light guidance member has substantially the same surface area as at least one of the mirror surface and the half-mirror layer.

13. The display device according to claim 1, wherein the display device comprises an automobile scuff plate device.

14. The display device according to claim 1, wherein the at least one light reflection and diffusion unit is disposed between about 2 mm and about 10 cm from the mirror surface.

15. The display device according to claim 14, wherein the at least one light reflection and diffusion unit is disposed between about 3 mm and about 5 mm from the mirror surface.

16. The display device according to claim 1, wherein the at least one light reflection and diffusion unit is disposed between about 2 mm and about 5 mm from the half mirror layer.

17. The display device according to claim 16, wherein the at least one light reflection and diffusion unit is disposed between about 2 mm and about 3 mm from the half mirror layer.

18. The display device according to claim 1, further comprising a protective plate disposed on a side of the half mirror layer opposite to the mirror surface.

19. The display device according to claim 1, wherein substantially an entirety of the translucent layer is filled up by the at least one light guidance member.

20. A display device to provide a luminous display of a pattern, said display device comprising:

a mirror surface;

a half mirror layer formed above the mirror surface;

a plurality of light guidance members that fills up an entirety of a space between said half mirror layer and said mirror surface by attaching surfaces of each of the light guidance members together, said each of said light guidance members comprising a transparent material dispersed in an entirety of said each of said light guidance members; and a pattern area having a desired form of the pattern disposed within one of said light guidance members and on a surface of another of said light guidance members attached to said one of the light guidance member, said pattern area being positioned at a first distance from the mirror surface and a second distance from the half mirror layer.

* * * * *